US007334386B2

(12) United States Patent
Higer

(10) Patent No.: US 7,334,386 B2
(45) Date of Patent: Feb. 26, 2008

(54) VACUUM PUMP CONTROL AND VACUUM FEEDBACK

(75) Inventor: Landen Higer, Hercules, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 172 days.

(21) Appl. No.: 11/352,604

(22) Filed: Feb. 13, 2006

(65) Prior Publication Data

US 2006/0123737 A1 Jun. 15, 2006

Related U.S. Application Data

(62) Division of application No. 10/884,008, filed on Jul. 2, 2004, now Pat. No. 7,021,027.

(60) Provisional application No. 60/490,842, filed on Jul. 29, 2003.

(51) Int. Cl.
*B65B 31/00* (2006.01)
*B65B 63/00* (2006.01)

(52) U.S. Cl. ..... 53/512; 53/52

(58) Field of Classification Search ..... 53/52, 53/56, 58, 503, 86, 512, 393, 432, 434, 477, 53/479, 469
See application file for complete search history.

(56) References Cited

U.S. PATENT DOCUMENTS

| | | | |
|---|---|---|---|
| 1,143,579 | A | 6/1915 | Denhard |
| 2,079,069 | A | 5/1937 | Johnson |
| 2,319,011 | A | 5/1943 | Meredith |
| 2,354,423 | A | 7/1944 | Rosenberger |
| 2,421,149 | A | 5/1947 | Hard et al. |
| 2,568,226 | A | 9/1951 | Drake |
| 2,617,304 | A | 11/1952 | Conover |
| 2,749,686 | A | 6/1956 | Lorenz et al. |
| 2,778,171 | A | 1/1957 | Taunton |
| 2,899,786 | A | 8/1959 | Harker |
| 3,038,283 | A | 6/1962 | Unger |
| 3,148,269 | A | 9/1964 | Van Hartesveldt et al. |
| 3,464,256 | A | 9/1969 | Lloyd |
| 3,516,223 | A | 6/1970 | Andersen et al. |
| 3,688,463 | A | 9/1972 | Titchenal |
| 3,699,742 | A | 10/1972 | Giraudi |
| 3,928,938 | A | 12/1975 | Burrell |
| 3,962,847 | A | 6/1976 | Trudel |
| 3,965,646 | A | 6/1976 | Hawkins |
| 4,006,329 | A | 2/1977 | Hellman et al. |
| 4,008,601 | A | 2/1977 | Woods |
| 4,105,491 | A | 8/1978 | Haase et al. |
| 4,164,111 | A | 8/1979 | Di Bernardo |

(Continued)

FOREIGN PATENT DOCUMENTS

| | | |
|---|---|---|
| EP | 0723915 A1 | 7/1996 |

(Continued)

*Primary Examiner*—Rinaldi I. Rada
*Assistant Examiner*—John Paradiso
(74) *Attorney, Agent, or Firm*—Hoffmann & Baron, LLP

(57) ABSTRACT

The invention is directed to methods providing intelligent and variable speed control of a vacuum pump, intelligent vacuum pump controllers, intelligent vacuum packaging appliances, and vacuum feedback devices and methods. This Abstract is provided to comply with the rules requiring an abstract. It is submitted with the understanding that it will not be used to interpret or limit the scope or meaning of the claims. 37 C.F.R. § 1.72(*b*).

7 Claims, 14 Drawing Sheets

U.S. PATENT DOCUMENTS

| | | | |
|---|---|---|---|
| 4,208,902 | A | 6/1980 | Kim et al. |
| 4,330,975 | A | 5/1982 | Kakiuchi |
| 4,372,096 | A | 2/1983 | Baum |
| 4,541,224 | A | 9/1985 | Mugnai |
| 4,545,177 | A | 10/1985 | Day |
| 4,549,387 | A | 10/1985 | Marshall et al. |
| 4,561,925 | A | 12/1985 | Skerjanec et al. |
| 4,578,928 | A | 4/1986 | Andre et al. |
| 4,581,764 | A | 4/1986 | Plock et al. |
| 4,631,512 | A | 12/1986 | Hishiki et al. |
| 4,641,482 | A | 2/1987 | Metz |
| 4,928,829 | A | 5/1990 | Di Bernardo |
| 4,941,310 | A | 7/1990 | Kristen |
| 5,048,269 | A | 9/1991 | Deni |
| 5,352,323 | A | 10/1994 | Chi |
| 5,461,901 | A | 10/1995 | Ottestad |
| 5,481,852 | A | 1/1996 | Mitchell |
| 5,528,880 | A | 6/1996 | Landolt |
| 5,551,213 | A | 9/1996 | Koelsch et al. |
| 5,608,167 | A | 3/1997 | Hale et al. |
| 5,655,357 | A | 8/1997 | Kristen |
| D389,847 | S | 1/1998 | Huang |
| 5,712,553 | A | 1/1998 | Hallberg |
| 5,765,608 | A | 6/1998 | Kristen |
| 5,784,862 | A | 7/1998 | Germano |
| 5,825,974 | A | 10/1998 | Hutton |
| 5,893,822 | A | 4/1999 | Deni |
| 6,058,998 | A | 5/2000 | Kristen |
| 6,106,449 | A | 8/2000 | Wynne |
| 6,124,558 | A | 9/2000 | Baumeister et al. |
| 6,256,968 | B1 | 7/2001 | Kristen |
| 6,328,897 | B1 | 12/2001 | Leung |
| 6,467,242 | B1 | 10/2002 | Huang |
| 6,520,071 | B1 | 2/2003 | Lanza |
| 6,623,413 | B1 | 9/2003 | Wynne |
| 6,694,710 | B2 | 2/2004 | Wang |

FOREIGN PATENT DOCUMENTS

| | | |
|---|---|---|
| EP | 1053945 A1 | 11/2000 |
| JP | 05-10211 | 2/1993 |
| JP | 2000-43818 | 2/2000 |
| WO | WO00/71422 | 11/2000 |

VACUUM PUMP CONTROL AND VACUUM FEEDBACK

CROSS-REFERENCE TO RELATED APPLICATIONS

The present application is a divisional of U.S. patent application Ser. No. 10/884,008 filed on Jul. 2, 2004, now U.S. Pat. No. 7,021,027 which claims priority to Higer's U.S. provisional patent application 60/490,842, filed Jul. 29, 2003, and entitled VACUUM PUMP CONTROL, the contents of these applications are incorporated herein by reference.

TECHNICAL FIELD

The present invention generally relates to vacuum packaging. More particularly, the invention is directed to intelligent and variable speed control of a vacuum pump, intelligent vacuum pump controllers, and intelligent vacuum packaging appliances, as well as vacuum feedback.

BACKGROUND

Vacuum packaging involves removing air or other gases from a storage container and then sealing the container to prevent the contents from being exposed to the air. Vacuum packaging is particularly useful in protecting food and other perishables against oxidation. Oxygen is a main cause of food spoilage and contributes to the growth of bacteria, mold, and yeast. Accordingly, vacuum packaged food often lasts three to five times longer than food stored in ordinary containers. Moreover, vacuum packaging is useful for storing clothes, photographs, silver, and other items to prevent discoloration, corrosion, rust, and tarnishing. Furthermore, vacuum packaging produces tight, strong, and compact packages to reduce the bulk of articles and allow for more space to store other supplies.

FIGS. 1A and 1B are schematic isometric views of a conventional appliance 80 for vacuum packaging an object 79 in accordance with the prior art. The vacuum packaging appliance 80 includes a base 82, a hood 90 pivotably coupled to the base 82, a lower trough 84, an upper trough (not shown) aligned with the lower trough 84, and a vacuum pump (not shown) operably coupled to the upper trough. The hood 90 pivots between an open position (shown in FIG. 1B) in which a bag 70 can be placed between the hood 90 and the base 82 and a closed position (shown in FIG. 1A) in which the bag 70 can be evacuated and thermally sealed.

In the closed position of FIG. 1A, the upper trough and the lower trough 84 form a vacuum chamber to remove gas from the interior of the bag 70. The base 82 also includes a seal 85 surrounding the vacuum chamber to seal the chamber from ambient air while gas is removed from the interior of the bag 70. The vacuum packaging appliance 80 also includes a heating element 88 to thermally seal the bag 70 after the gas has been evacuated.

Conventional vacuum packaging bags include two panels attached together with an open end. Typically, the panels each include two or more layers. The inner layer can be a heat sealable material, and the outer layer can be a gas impermeable material to provide a barrier against the influx of air. The plasticity temperature of the inner layer is lower than the outer layer. Accordingly, the bag can be heated to thermally bond the inner layer of each panel together to seal the bag without melting or puncturing the outer layer during the heat sealing cycle.

A conventional vacuum packaging process includes depositing the object 79 into the bag 70 and positioning an open end 71 of the bag 70 proximate to the lower trough 84 of the vacuum packaging appliance 80. Next, the hood 90 pivots downward to form the vacuum chamber around the open end 71 of the bag 70. The vacuum pump then removes gas from the vacuum chamber and the interior of the bag 70, which is in fluid communication with the vacuum chamber. After the gas has been removed from the interior of the bag 70, the heating element 88 heats a strip of the bag 70 proximate to the open end 71 to melt the inner layer of each panel and thermally seal the bag 70.

FIG. 2 is a flow chart illustrating a method 10 for operation of the vacuum pump of the vacuum packaging appliance in accordance with a conventional vacuum packaging process. A step 12 involves coupling a storage receptacle to a vacuum circuit of the vacuum packaging appliance. As will be appreciated, the vacuum circuit is coupled to the vacuum pump such that actuation of the vacuum pump results in evacuation of the vacuum circuit. By coupling the storage receptacle (bag as described above, canister, etc.) to the vacuum circuit, actuation of the vacuum pump will result in evacuation of the storage receptacle.

A step 14 hermetically closes the vacuum circuit. For example, step 14 may correspond to closing the hood 90 as described above. Step 14 insures that evacuation of the storage receptacle will result eventually in the storage receptacle reaching a gas pressure that is sufficiently near absolute vacuum to accomplish the intended purpose.

A step 16 actuates the vacuum pump at a constant evacuation speed fixed by the control circuitry of the vacuum packaging appliance. Step 16 is accomplished manually by a user actuating a control switch. This control switch may be attached to a button made available to the user, or may be formed into the vacuum packaging appliance such that when the vacuum circuit is hermetically sealed, the control switch actuates. The vacuum pump operates at the constant predefined evacuation speed until the user turns the machine off, or in some instances a vacuum sensor is placed in the vacuum circuit and the vacuum pump is turned off when the vacuum of the vacuum circuit reaches a certain predefined level.

FIG. 3 is a graphical illustration 50 symbolic of a vacuum level 52 of a bag-like storage receptacle ("bag") during evacuation via the prior art single speed evacuation. As can be seen, the bag maintains a substantially constant vacuum level during an initial phase 54 of evacuation. The substantially constant vacuum level of the initial phase 54 results from the volume of the bag adjusting substantially proportionally to the volume of gas evacuated from the bag. Once the volume of the bag has compressed to a critical volume (depends upon the bag etc.), evacuation of the bag begins to substantially decrease bag pressure as shown during the critical phase 56 of vacuum level 52. Assuming the pump is allowed to continuously operate, the vacuum level 52 of the bag will reach a final level during a final phase 58. The final vacuum level will be determined by the strength of the vacuum pump.

The prior art teaches a single, constant speed vacuum pump. During the initial phase, the vacuum pump is not taxed, however during the critical phase and the final phase, the vacuum pump can be taxed. The vacuum speed of the prior art must be selected such that the pump motor operates safely during all phases of evacuation. A desirable feature to most users of the vacuum packaging appliance is to evacuate the bag as fast as possible. Thus the prior art teaches setting the vacuum pump evacuation speed as fast as will safely operate during the critical and final phases.

Unfortunately, this single, high-speed approach is not well suited for fragile contents in collapsible bags, as the user cannot stop the vacuum in time. Additionally, there are periods of evacuation when the vacuum pump could be run at higher rates without causing damage to the vacuum pump. This means the prior art teaching does not optimize evacuation speed.

Another problem with conventional vacuum packaging appliances is the lack of vacuum level feedback information provided to the user. During evacuation the user has no knowledge of the vacuum level at any given point in time. As a result, the user has to make a visual determination when to turn off the machine or rely on the machine's predefined vacuum level to automatically stop the vacuum pump. A lack of user interaction may result in damaging fragile contents and in some instances, may result in incomplete evacuation due to the storage receptacle.

The capability to sense various vacuum levels with user feedback would be particularly useful when the content in a collapsible storage receptacle is fragile. For example, when storing fragile items a user may want to deactivate the vacuum pump during the critical phase to avoid damaging the fragile contents. In other circumstances, the user may choose to prolong evacuation until the vacuum level reaches the final phase 58 to prevent incomplete evacuation. This functionality is not accomplished by the prior art.

Accordingly, there is a need for user feedback information regarding vacuum levels during evacuation to facilitate user interaction with the vacuum packaging appliance. Additionally, there is a need for more sophisticated vacuum sensing and vacuum pump control.

BRIEF DESCRIPTION OF THE DRAWINGS

PRIOR ART

PRIOR ART

PRIOR ART

DETAILED DESCRIPTION

The invention is directed to methods providing intelligent and variable speed control of a vacuum pump, intelligent vacuum pump controllers, and intelligent vacuum packaging appliances.

Figure 1A:
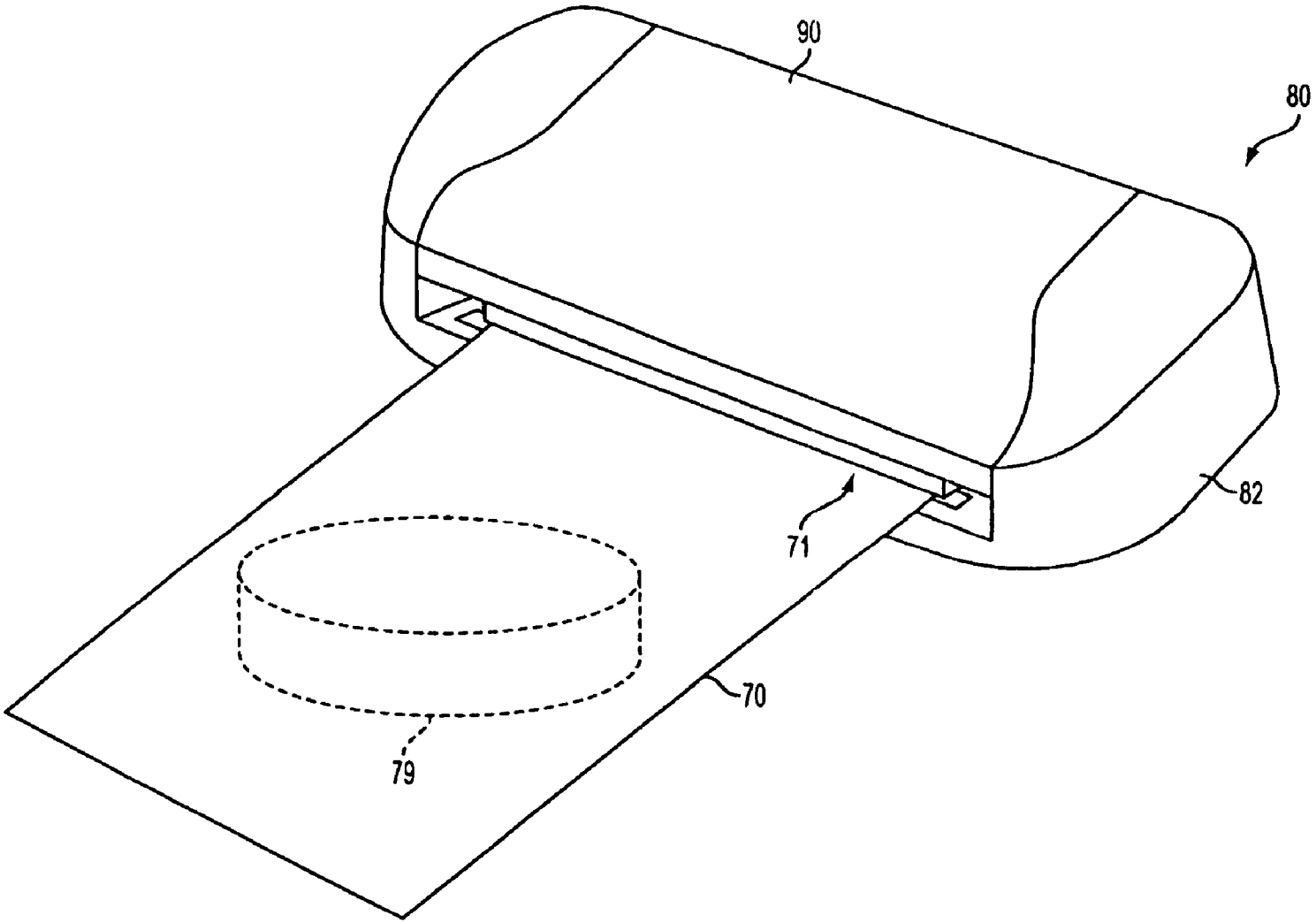
FIG. 1A PRIOR ART
FIGS. 1A and 1B are schematic isometric views of a conventional appliance for vacuum packaging objects in accordance with the prior art.
Figure 1B:
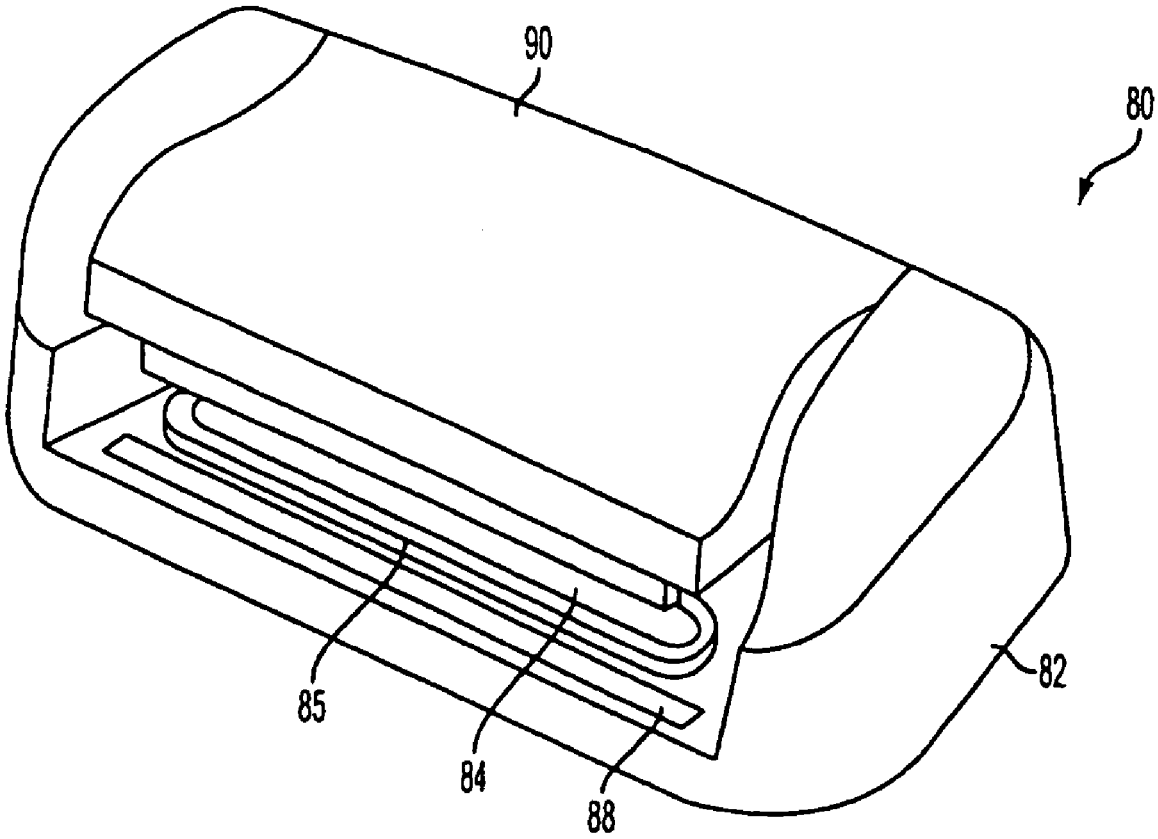
FIG. 1B PRIOR ART
Figure 2:
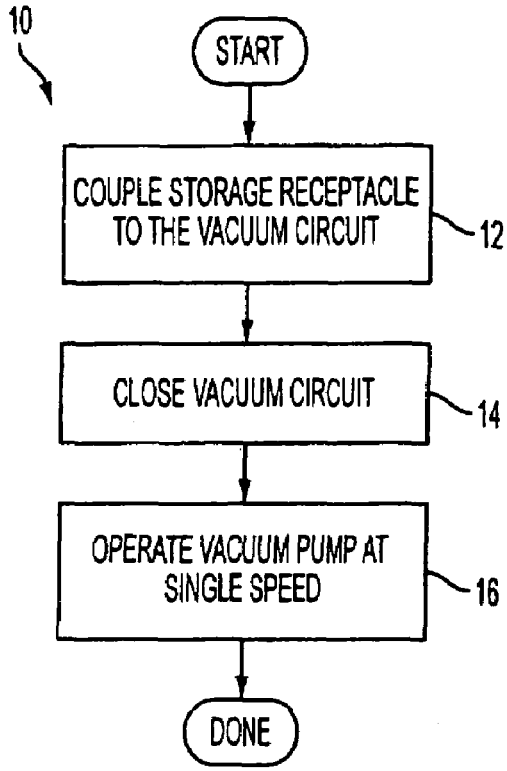
FIG. 2 PRIOR ART
FIG. 2 is a flow chart for the operation of the vacuum pump of the vacuum packaging appliance in accordance with a conventional vacuum packaging process.
Figure 3:
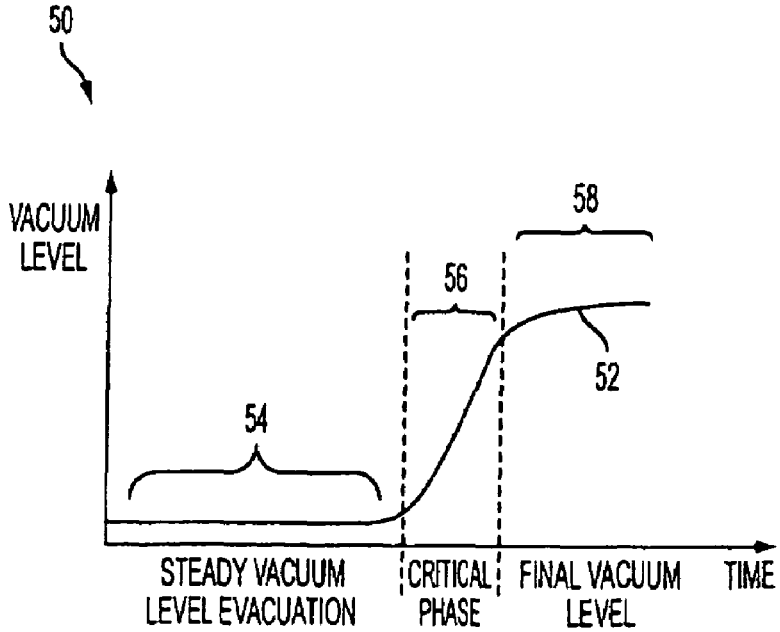
FIG. 3 PRIOR ART
FIG. 3 is a graphical depiction of vacuum levels in a vacuum circuit during evacuation using a conventional single-speed vacuum packaging appliance in accordance with the prior art.
Figure 4:
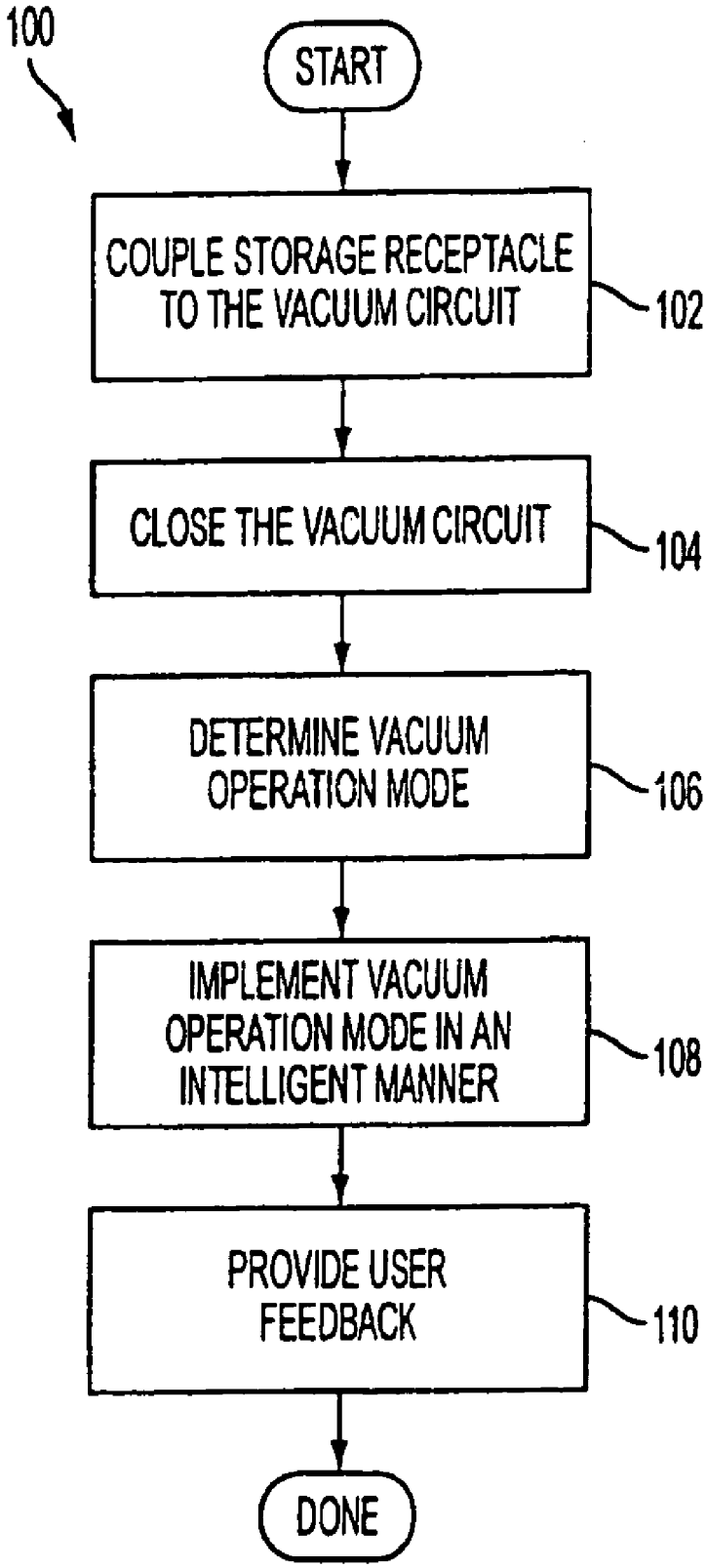
FIG. 4 is a flow chart illustrating a vacuum pump control method 100 in accordance with one embodiment of the present invention.

FIG. 4 is a flow chart illustrating a vacuum pump control method 100 in accordance with one embodiment of the present invention. The control method 100 contemplates intelligent control of the vacuum pump including variable speed operation of the vacuum pump, as well as modes of pump operation that take into consideration the nature of the vacuum packaging receptacle and the contents therein. The method 100 is well suited for controlling operation of a vacuum packaging appliance having a vacuum pump coupled to a vacuum circuit, and a vacuum sensor placed within the vacuum circuit.

A first step 102 involves coupling a vacuum storage receptacle to the vacuum circuit. The present invention contemplates a wide variety of suitable vacuum storage receptacles including heat sealable bag-like receptacles and hard walled canisters. Vacuum storage receptacles, and their interface with different types of vacuum packaging appliances will be appreciated by those skilled in the art. A step 104 closes the vacuum circuit so that the vacuum storage receptacle and the vacuum circuit are substantially hermetically sealed.

A step 106 determines a vacuum mode operation. The present invention contemplates a wide range of possible operation modes. The mode may be a function of a user selection or input, as a function of one or more sensed parameters such as vacuum level, fluid level, temperature of heat sealing element, etc., or a function of both user selection and sensed parameters. A step 108 operates the vacuum packaging appliance in the operation mode determined in step 106. The operation step 108 is performed in an intelligent manner, based on the determined mode and in certain embodiments based on continued monitoring of one or more parameters, user input, etc.

A step 110 provides the user feedback regarding operation of the vacuum pump. For example, the vacuum packaging appliance may be equipped with several lights which could indicate messages such as selected or determined operation mode, status of vacuum pump, status of vacuum level, and status of heat sealing operation. Of course, step 110 is an optional step.

Figure 5:
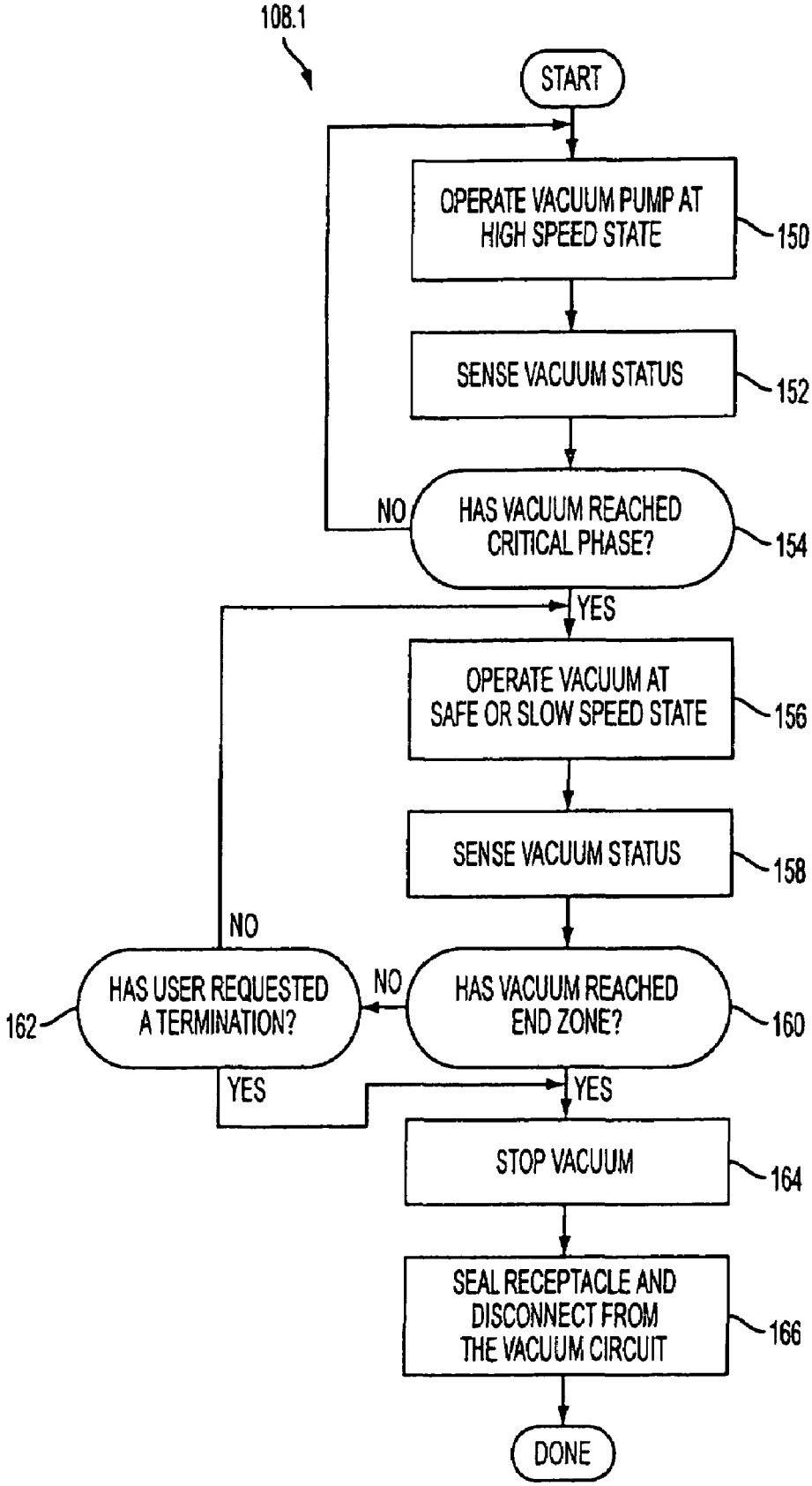
FIG. 5 is a flow chart illustrating a method for controlling a vacuum pump of a vacuum packaging appliance in accordance with one vacuum operation mode.

FIG. 5 illustrates a method 108.1 for controlling a vacuum pump of a vacuum packaging appliance in accordance with one embodiment of the present invention. The method 108.1 provides an intelligent manner for operating the vacuum pump at variable speeds, and can be safely used during a standard operating mode or a fragile operating mode, as well as other modes of operation. Essentially, the method 108.1 operates the vacuum pump at a high speed during the initial phase, a safe speed or low speed (depending upon the mode) during the critical phase, and then stops the vacuum pump upon reaching the final phase.

Turning directly to FIG. 5, a step 150 begins operation of the vacuum pump at a high speed. The method 108.1 teaches operating the vacuum pump in an overdrive mode during the initial phase of evacuation. Because the vacuum packaging receptacle is at a constant relatively high pressure state during the initial phase of evacuation, the stress placed on the vacuum pump is relatively low making operation in an overdrive mode safe. A step 152 determines a vacuum level in the vacuum circuit, typically through a vacuum sensor disposed within the vacuum circuit. The vacuum sensor may be a discrete sensor providing binary data indicating the phase of the vacuum circuit. Alternative, the vacuum sensor may provide a continuous output related to vacuum level in the vacuum circuit.

A step 154 determines whether the vacuum level of the vacuum circuit has reached the critical phase. When the vacuum level is still in the initial phase, control is passed back to step 150 and operation of the vacuum pump is continued in the overdrive state.

When step 154 determines that the vacuum circuit vacuum level has entered the critical phase, control passes to a step 156 that transitions the vacuum pump operation to a safe operating or slow operating speed. The safe operating speed corresponds to a safe mode of operation intended for shorter evacuation periods that tend not to place undue stress on the vacuum pump. This is accomplished by decreasing the vacuum pump speed to a speed safe for operation during the critical and final phases. The slow speed corresponds to a fragile content mode of operation, and increases the time length of the critical phase such that the user has enough time to intervene and disable the vacuum pump should the integrity of the contents be threatened by the force of the collapsing receptacle.

A next step 158 again determines the vacuum level of the vacuum circuit. A step 160 determines whether the vacuum level of the vacuum circuit has reached the final phase. When the vacuum level is still in the critical phase, control passes to a step 162 that determines whether the user has requested that the vacuum pump cease operation. When the user has requested termination, control passes to a step 164, which stops operation of the vacuum pump. Then a step 166 finishes the process by hermetically sealing the vacuum packaging receptacle and disconnecting the vacuum packaging receptacle from the vacuum circuit. Likewise, when step 160 determines that the vacuum circuit has reached the final phase, control is passed to the stop vacuum step 164 and then to the final step 166.

Figure 6:
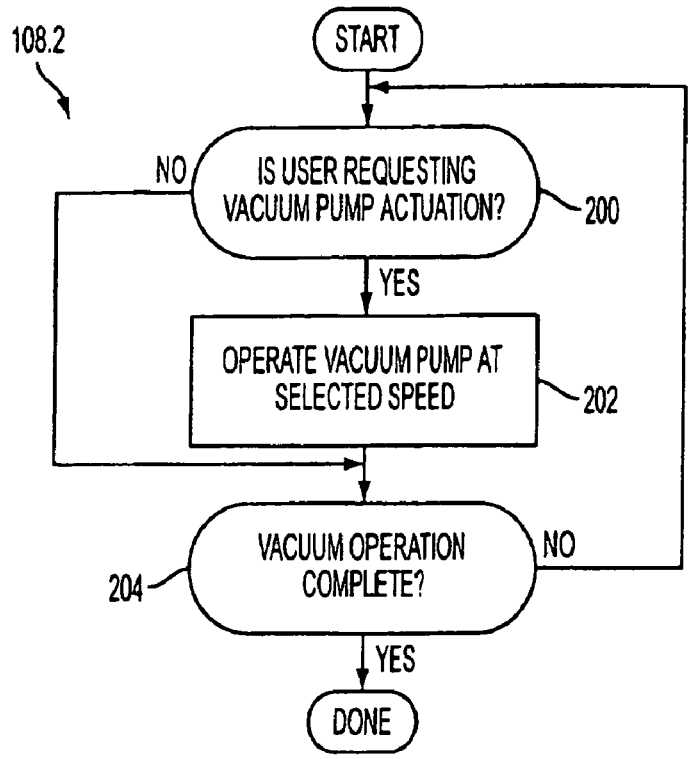
FIG. 6 is a flow chart illustrating a method for controlling a vacuum pump of a vacuum packaging appliance according to another vacuum operation mode.

FIG. 6 is a flow chart illustrating a method 108.2 for a manual evacuation mode of operation for a vacuum packaging appliance in accordance with another embodiment of the present invention. In the manual mode, the user manually activates the vacuum pump, and the operation of the vacuum pump may continue until the user ceases requesting activation or a final phase of the vacuum level is reached.

A step 200 monitors user input to determine whether the user has requested activation of the vacuum pump. The present invention contemplates a variety of mechanisms providing a control interface to the user. For example, the vacuum packaging appliance may be equipped with a single on/off switch. This switch may directly activate the vacuum pump, or may be fed as input into a controller such as an electronic control circuit, an ASIC, a PLD, a microprocessor or microcontroller that in turn controls the vacuum pump. The control may operate such that momentary switch actuation toggles the vacuum pump on and off; e.g., push once to begin evacuation, push again to stop evacuation. Alternatively, the control may require the user to continue actuation to maintain vacuum pump activation; e.g., push and hold down to begin evacuation, release button to stop evacuation. The user may also be provided multiple speed control.

Once the user requests a specific pump activation, a step 202 actuates the vacuum pump as requested by the user. A step 204 monitors the vacuum level and when it reaches the final phase, the method 108.2 is completed. If the vacuum level has not reached the final phase, control returns back to pump activation step 200. Step 204 is optional, and certain embodiments will rely on the user to deactivate the vacuum pump.

Figure 7:
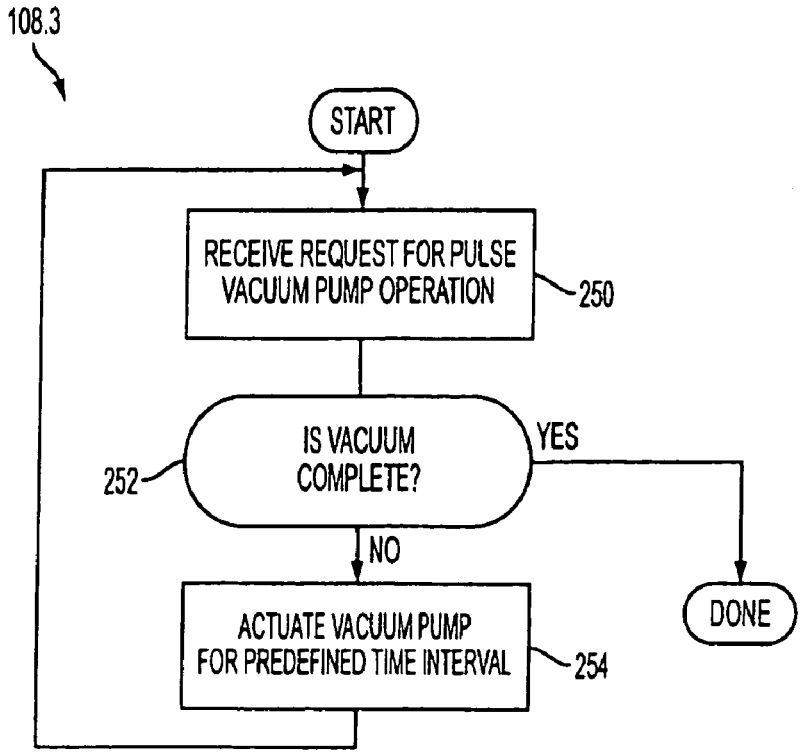
FIG. 7 is a flow chart illustrating a method for controlling a vacuum pump of a vacuum packaging appliance in accordance with still another vacuum operation mode.

FIG. 7 is a flow chart illustrating a pulse operation method 108.3 in accordance with yet another embodiment of the present invention. In a first step 250, a user requests a pulse evacuation operation. A step 252 then determines whether the vacuum level has reach a final phase. When the vacuum is not complete, a step 254 actuates the vacuum pump for a fixed and predetermined period of time (a "pulse"). Then control passes back to step 205 to respond to a user's request. Note that these steps can be performed in parallel, such that the vacuum sensing and cut off at final phase can occur at any point.

Of course, the modes of operation can take on many embodiments, and the descriptions herein are merely intended to be illustrative. Certain embodiments may allow the user to select a period of evacuation, which is a multiple of the pulse length by making multiple requests (e.g., pushing pulse button multiple times). Step 252 can be optional, allowing the user to continue evacuating (e.g., running the pump motor) regardless of the vacuum level.

Additionally, feedback such as a blinking light may be provided when the vacuum level reaches or approaches a desired point. Still further, evacuation may terminate upon sealing of the bag through manual or automatic operation the heat sealing element.

Figure 8:
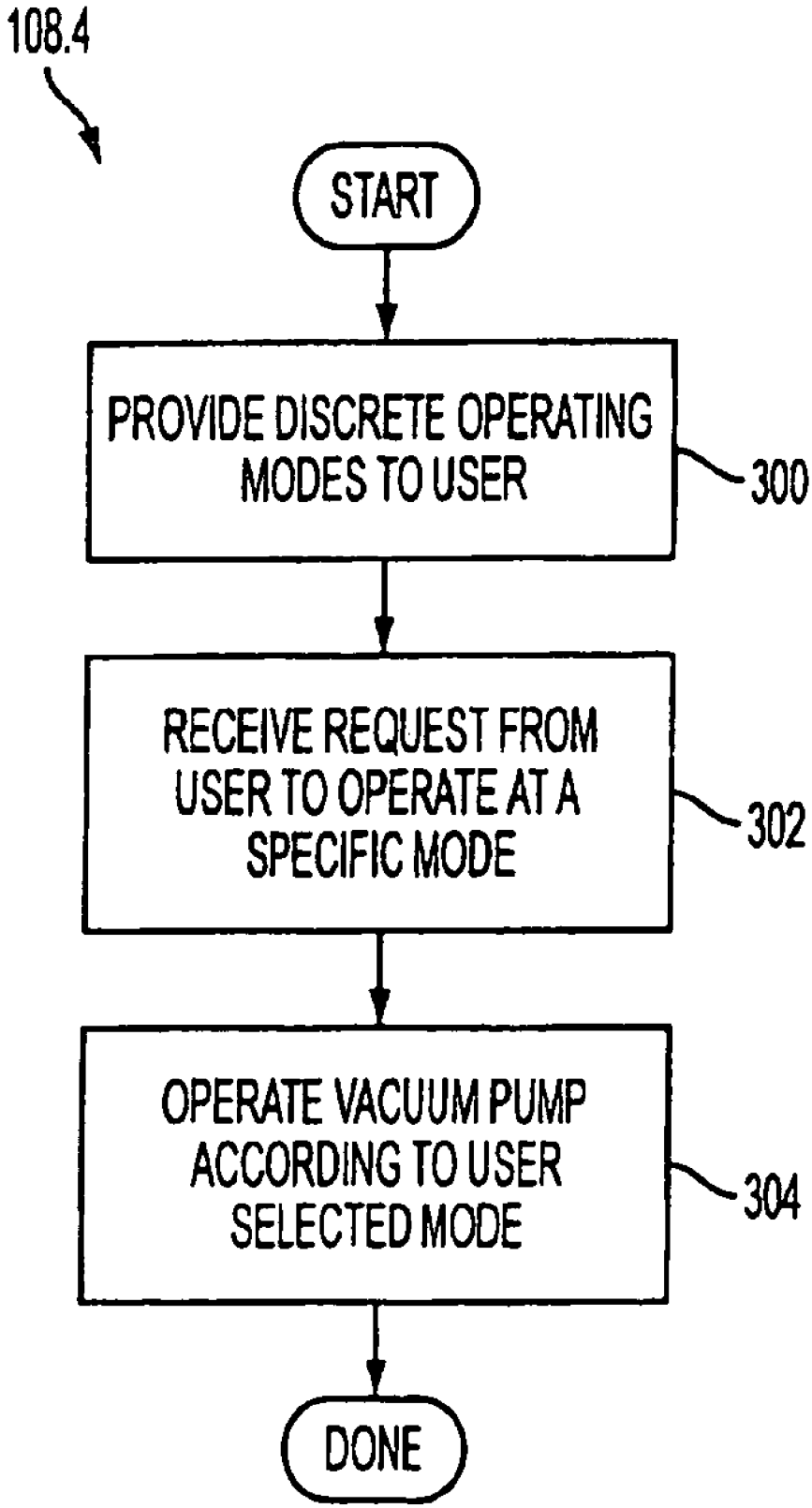
FIG. 8 is a flow chart illustrating a method for controlling a vacuum pump of a vacuum packaging appliance in accordance with yet another vacuum operation mode.

FIG. 8 is a flow chart illustrating a discrete mode method 108.4 in accordance with one aspect of the present invention. In a step 300, the user is provided a plurality of discrete operating modes. These could be any plurality of modes as described above with reference to FIGS. 6-7, and could be provided to the user via physical switches, a touch sensitive keypad, etc. A step 302 receives a request for a specific discrete mode of operation for the vacuum pump. A step 304 operates the vacuum pump according to a user-selected mode.

Figure 9:
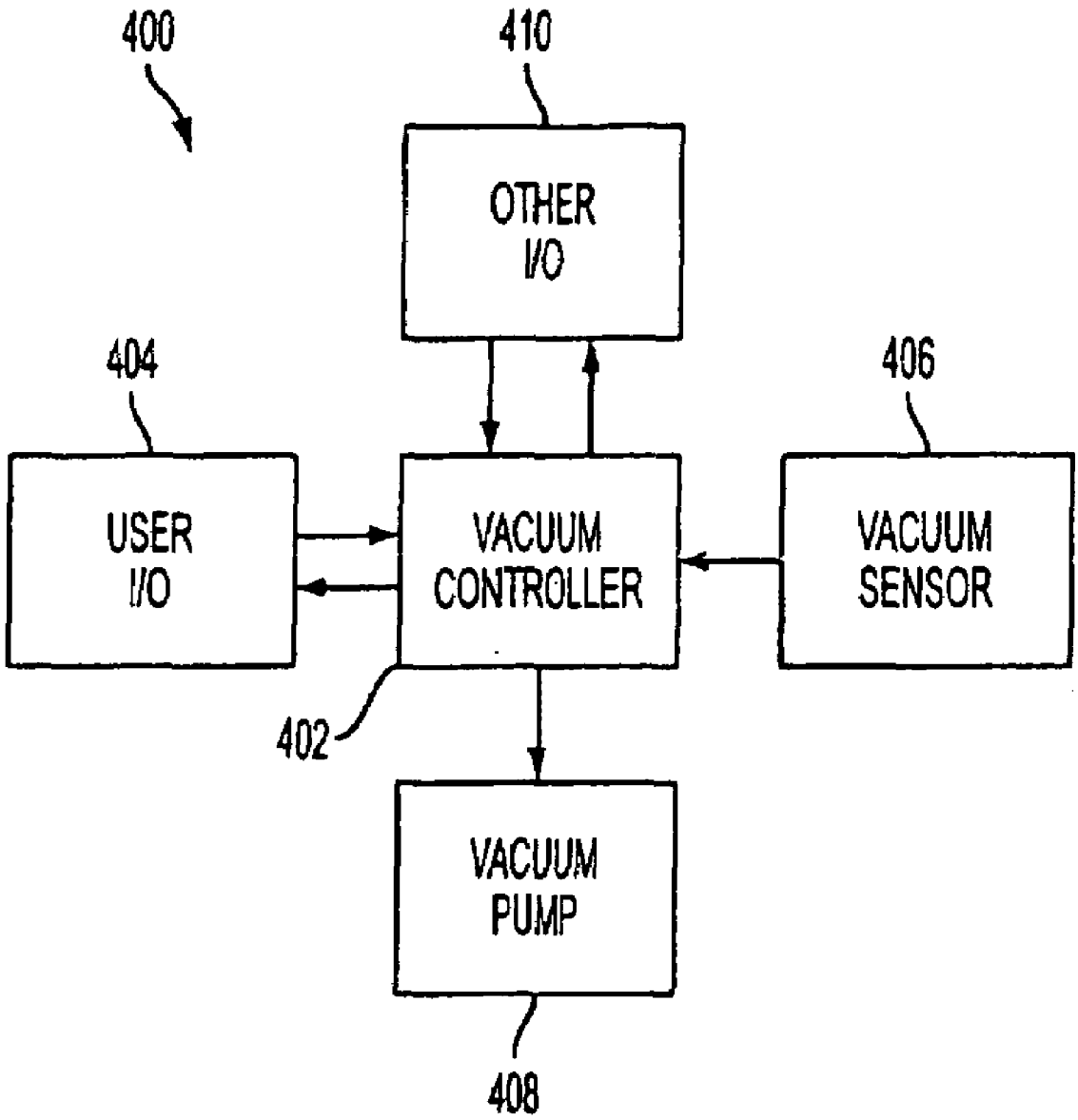
FIG. 9 is a block diagram electrical schematic of a vacuum packaging appliance in accordance with one embodiment of the present invention.

FIG. 9 is a block diagram electrical schematic of a vacuum packaging appliance 400 in accordance with one embodiment of the present invention. The vacuum packaging appliance 400 includes a vacuum controller 402, user i/o 404, a vacuum sensor 406, a vacuum pump 408, and other i/o 410.

The vacuum controller 402 is responsive to input from the user i/o 404, the vacuum sensor 406, and the other i/o 410 to control operation of the vacuum pump 408. The vacuum controller 402 may be an independent device, or may be a part of a system controlling all functions of the vacuum packaging appliance 400. The vacuum controller 402 may take the form of a microprocessor, a microcontroller, an ASIC, a PLD, an electronic circuit, or any other suitable form.

The user i/o 404 may include any suitable user interface. For example, the user i/o 404 may include one or more button actuated switches, a keypad and screen, a touchscreen, etc. The user i/o 404 enables the user to select modes of operation for the vacuum packaging appliance 400 related to vacuum pump and in certain embodiments other operations of the vacuum packaging appliance 400. The vacuum sensor 406 is disposed within the vacuum circuit and is operable to sense a vacuum level of the vacuum circuit. In certain embodiments, the vacuum sensor 406 can provide vacuum level data along a continuous scale. In other embodiments the vacuum sensor 406 provides a discrete output indicating transition from one vacuum phase to another, or perhaps several discrete outputs.

The vacuum pump 408 is coupled to the vacuum circuit and is operable to evacuate gas from the vacuum circuit when actuated by the vacuum controller 402. Other i/o 410 may include a temperature sensor coupled to a heat sealing mechanism of the vacuum packaging appliance 400.

Figure 10:
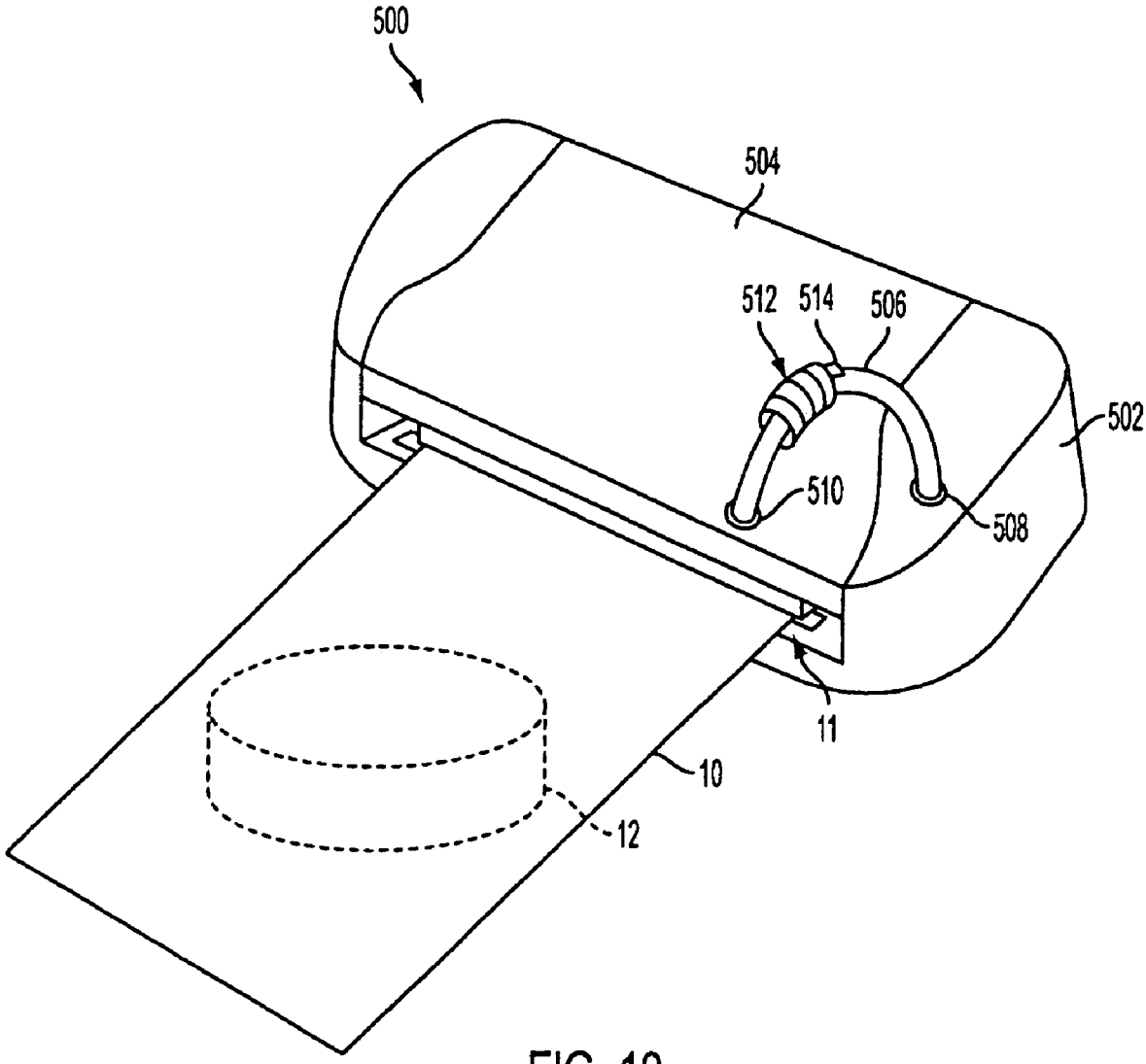
FIG. 10 illustrates a vacuum packaging appliance having a mechanical vacuum feedback device.

Vacuum packaging appliances having vacuum sensors with mechanical user feedback devices will now be described with reference to FIGS. 10-12. A vacuum packaging appliance 500 includes a base 502, a lid 504, a vacuum hose 506 coupling a first valve 508 formed in the base 502 to a second valve 570 formed in the lid 504, and a vacuum sensing module 512 circumferentially attached to the vacuum hose 506. The base 502 typically houses the components necessary for operation of a vacuum packaging appliance. These components typically include a vacuum pump, a vacuum circuit, a power supply, etc. The operation and the coupling of these elements are well known in the art and are described below in more detail.

The vacuum packaging appliance 500 includes a vacuum circuit made up of a vacuum chamber with a sealing strip, a vacuum pump, a vacuum hose 506 operationally connecting the vacuum pump through a first valve 508 to the vacuum chamber through a second valve 510, and a vacuum sensing module 512. To get the configuration of FIG. 11 from the device of FIG. 10, the vacuum hose 506 is disconnected from the second valve 510 and is operationally attached to canister 520 through a valve 522 on the lid of the canister.

Figure 11:
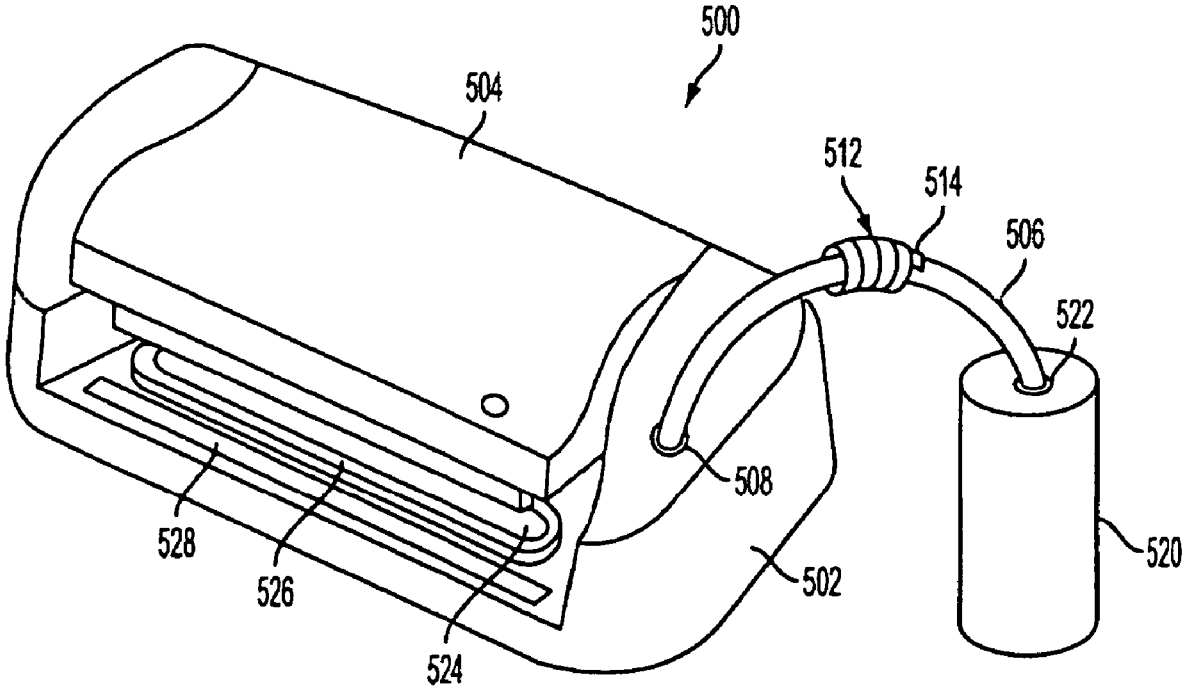
FIG. 11 illustrates the vacuum packaging appliance of FIG. 10 operating in an attachment mode.

FIG. 11 also illustrates the vacuum chamber including a lower trough 524 in the base 502 having a seal 526 around the circumference of the lower trough, an upper trough (not shown) in the lid 504 with a corresponding upper seal around the circumference of the upper trough and a heating strip 528. When lid 504 is in closed position, the lower seal and the upper seal form a seal around the vacuum chamber from ambient air while gas is evacuated from a storage receptacle. The vacuum sensing module, illustrated in FIG. 12, includes a vacuum sensor with a probe extending into the vacuum hose 506 for measuring the flow rate of the vacuum in the vacuum circuit and a mechanical display device, such as a barber-pole with a spiral banner.

Figure 12:
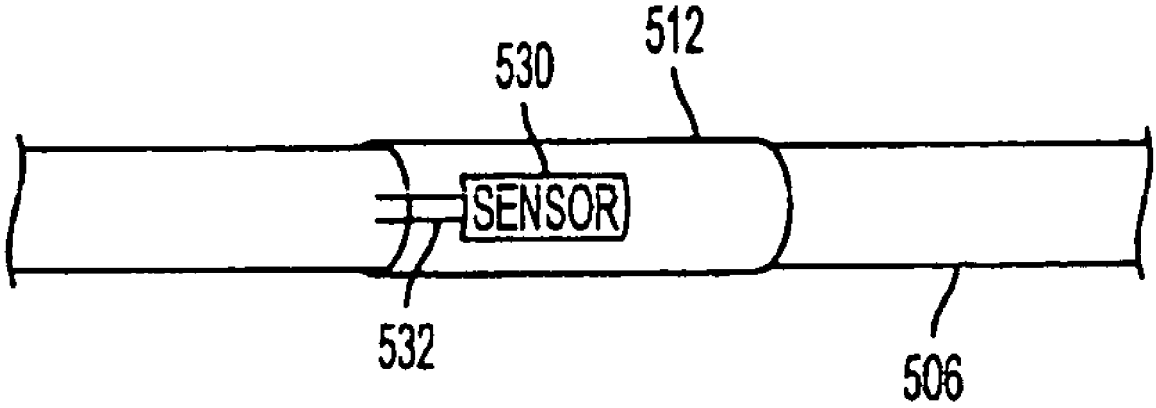
FIG. 12 illustrates a vacuum sensor within a vacuum hose.

A vacuum sensor 530 is shown in FIG. 12. Vacuum sensor 530 is embedded in vacuum hose 506 with probe 532 extending into the vacuum hose to measure the flow rate of the vacuum circuit. The spiral banner of the barber-pole device is driven by vacuum flow in the hose 506. The spiral banner rotates at a speed proportional to the vacuum level. For example, at the start of evacuation, the color-coded banner of the barber-pole is green. The banner rotates to yellow as the vacuum level increases. At the completion of evacuation, the banner of the barber-pole device is red. When the user begins an evacuation session, the spiral banner of the barber-pole mechanism is reset to an initial color of white by engaging a reset button 514. As the vacuum level enters the critical phase of evacuation, the barber-pole spiral mechanism will indicate that to the user. Upon recognizing that the vacuum level is in the critical phase, the user may decide to terminate evacuation, instead of continuing until the final vacuum level, if the content in the storage receptacle is fragile or susceptible to being crush.

The vacuum packaging appliance 500 as shown in FIG. 11 includes a vacuum circuit made up of a canister 520, a vacuum pump (not shown) and a vacuum hose 506 operationally connecting the vacuum pump through first valve 508 to the canister through second valve 522 on the lid of canister 520, and a vacuum sensing module 512 circumferentially attached to the vacuum hose 506. The vacuum sensing module includes a vacuum sensor with a probe extending into the vacuum hose 506 for measuring the flow rate of the vacuum in the vacuum circuit and a mechanical display device, such as a barber-pole with color-coded spiral mechanism.

Figure 13:
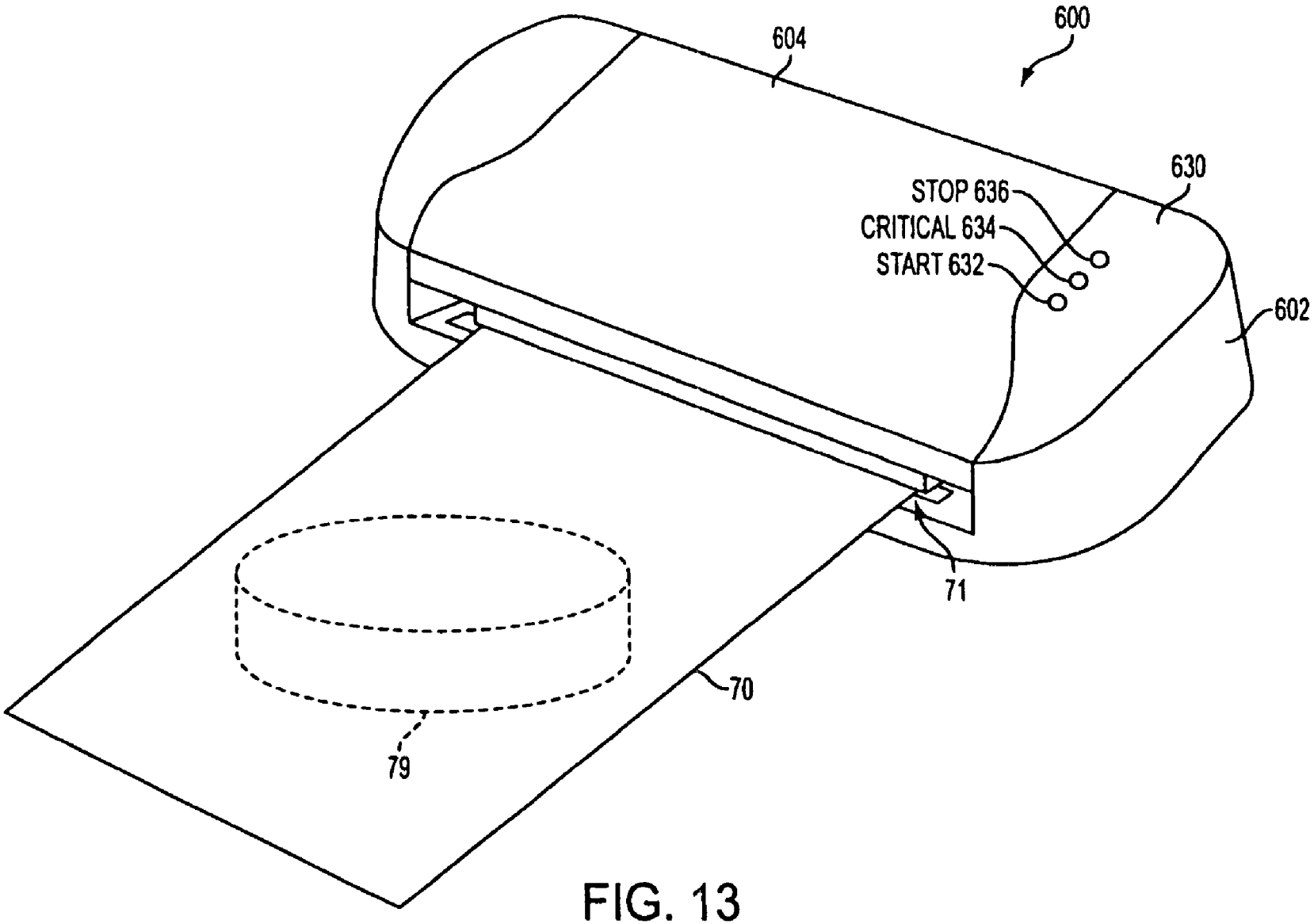
FIG. 13 illustrates a vacuum packaging appliance having an electronic vacuum feedback device.

FIG. 13 illustrates a vacuum packaging appliance having an electronic feedback device. In the illustrated embodiment, the vacuum packaging appliance 600 includes a base 602, a lid 604, and a vacuum sensing module coupled to a vacuum circuit housed within base 602. The vacuum sensing module includes a vacuum sensor, a controller, and a plurality of light emitting diodes ("LEDs") 630. The LEDs 630 provide user feedback information on the vacuum level during evacuation.

The vacuum sensor measures the flow rate of the vacuum level of the vacuum circuit. The controller analyzes the flow rate information from the vacuum sensor, determines the current vacuum level, and sends an electronic signal to turn on the LED that corresponds to the current vacuum level. For example, when the vacuum circuit is in the initial steady vacuum level, the controller sends a signal to turn on the LED 632 corresponding to "start." When the vacuum level is in the critical phase, the controller turns on the LED 634 corresponding to "critical." LED 636 corresponding to "stop" is illuminated when evacuation reached a final vacuum level.

Figure 14:
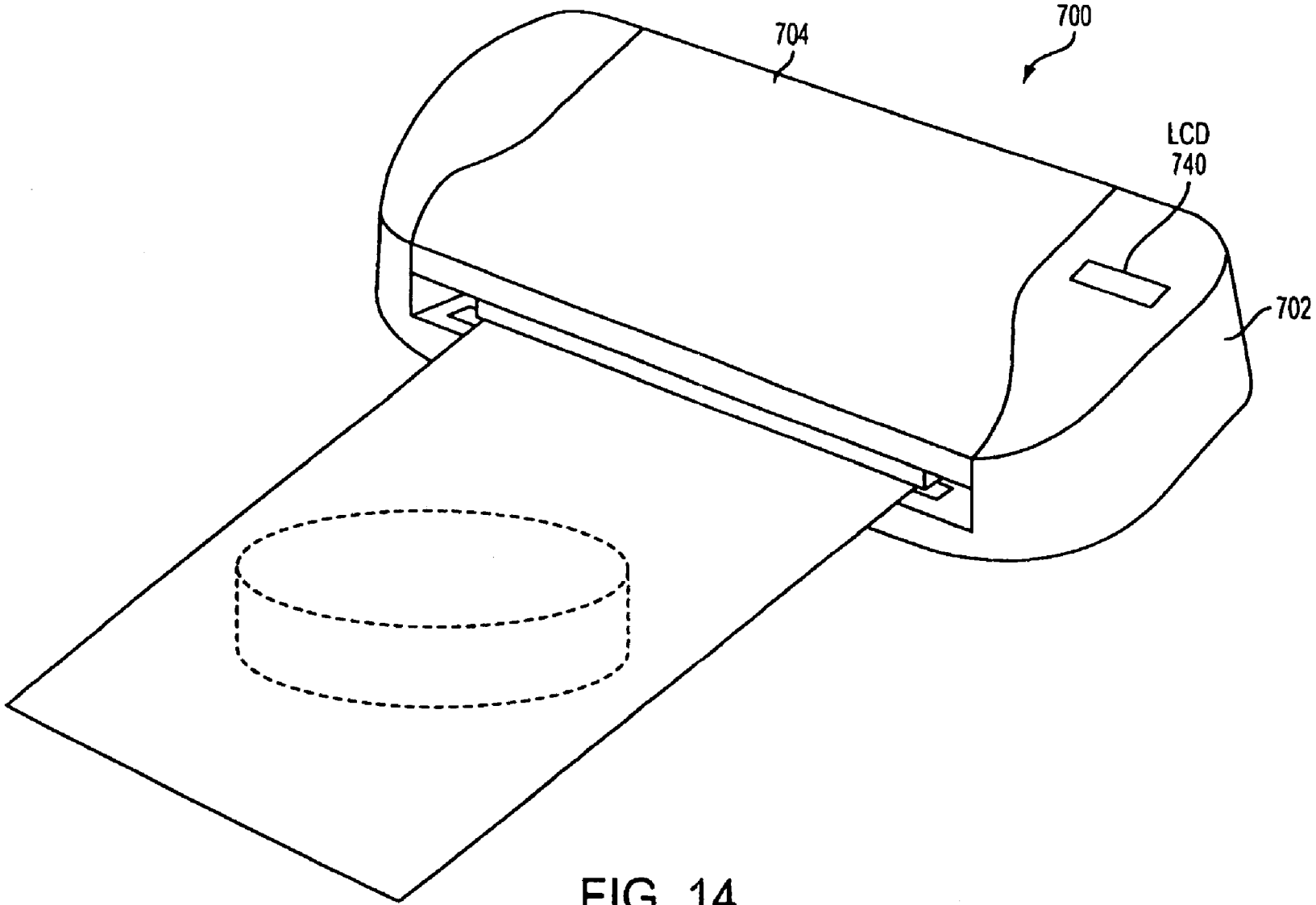
FIG. 14 illustrates a vacuum packaging appliance having an LED vacuum feedback device.

In another embodiment depicted in FIG. 14, a vacuum packaging appliance 700 includes a base 702, a lid 704, and a vacuum sensing module coupled to a vacuum circuit housed within base 702. The vacuum circuit and vacuum sensing module are embedded within the housing of the vacuum packaging appliance. The vacuum sensing module includes a vacuum sensor, a controller, and a liquid crystal display ("LCD") 740 shown in FIG. 14. User feedback information is displayed on the LCD.

The vacuum sensor measures the flow rate of the vacuum level of the vacuum circuit. The controller analyzes the flow rate information from the vacuum sensor, determines the current vacuum level, and sends an electronic signal to the LCD to display the current vacuum level information to the user. For example, when the vacuum circuit is in the initial steady vacuum level, the controller sends a signal to the LCD to display a message indicative of the initial vacuum level. When the vacuum level is in the critical phase, the controller sends a signal to the LCD to display feedback information to the user indicating that the vacuum level is in the critical phase.

Figure 15:
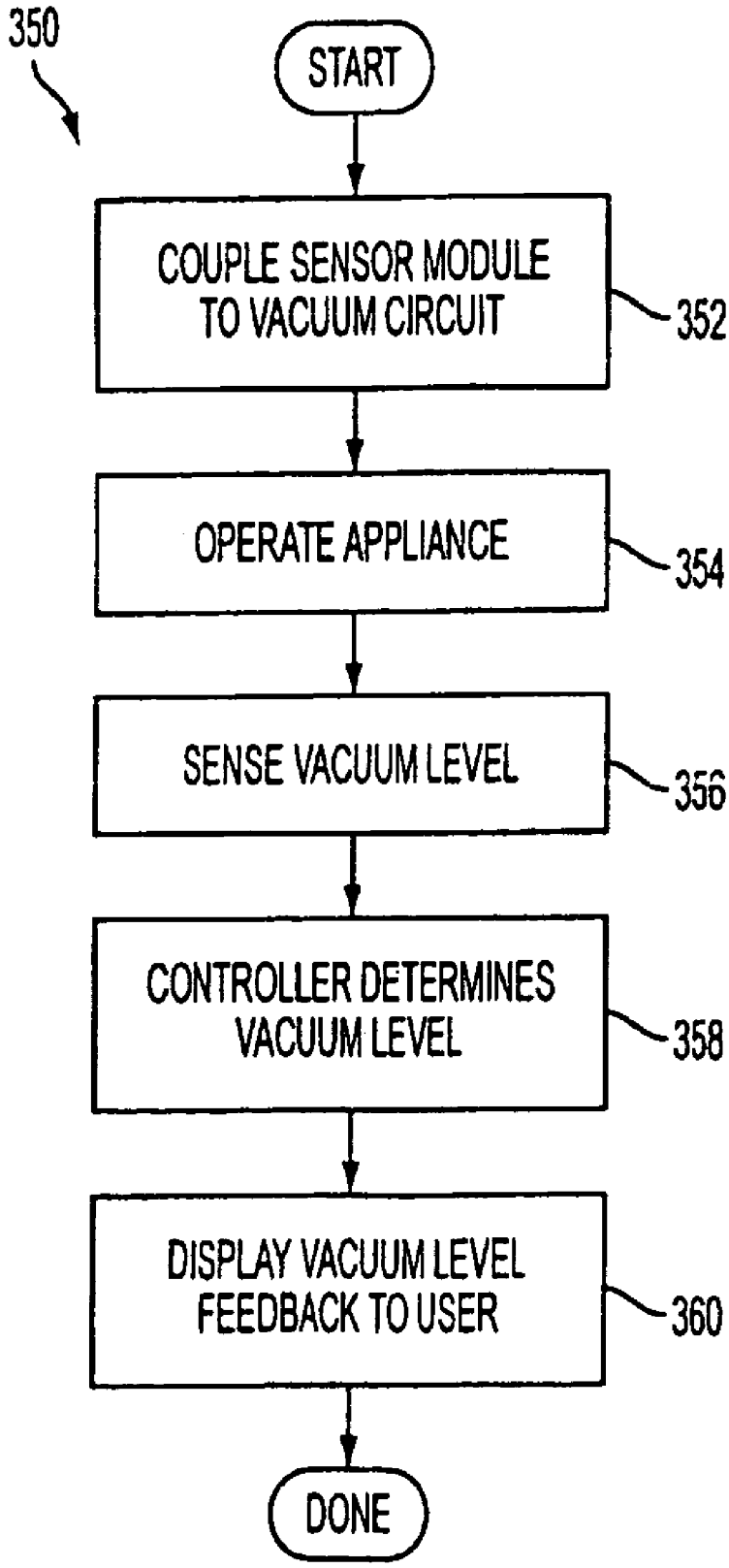
FIG. 15 is a flow chart of a method for operating a vacuum packaging device having vacuum feedback.

FIG. 15 is a flow chart illustrating a method 350 for evacuating a storage receptacle using a vacuum packaging appliance having a vacuum sensor with user feedback. At the start of the evacuation, a step 352 involves coupling the vacuum sensor to the vacuum circuit of the vacuum packaging appliance. If the vacuum sensor is permanently coupled to the vacuum circuit, step 352 is not needed. In order for the vacuum sensor to measure the flow rate of the vacuum level, it needs to be coupled to the vacuum circuit. After the vacuum sensor is in position to measure the flow rate of the vacuum circuit, whenever the user operates the vacuum packaging appliance in step 354 the sensor measures the flow rate of the vacuum circuit or in other words, senses the vacuum level in step 356. The controller determines the vacuum level based on the flow rate measured by the vacuum sensor in step 358. Then, in step 360 the controller formulates a signal and sends it to the electronic display to present the vacuum level information to the user.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A vacuum packaging appliance for use in evacuating vacuum packaging receptacles, said vacuum packaging appliance comprising:

a vacuum pump;

a vacuum circuit coupled to said vacuum pump such that actuation of said vacuum pump evacuates said vacuum circuit, said vacuum circuit intended for evacuating a vacuum packaging receptacle;

a vacuum sensing device coupled to said vacuum circuit and operable to sense a vacuum level of said vacuum circuit;

a user input device operably enabling a user to select a mode of operation from among at least a first and second operating mode; and a vacuum pump controller operable to actuate said vacuum pump according to a first control profile associated with said first operating mode and a second control profile associated with said second operating mode, said vacuum pump coupled and responsive to said vacuum sensing device, said vacuum pump controller responsive to said user input device, said first control profile having a first evacuation rate and a second evacuation rate, said first evacuation rate corresponding to a first pump speed higher than a second pump speed correlated with said second evacuation rate.

2. A vacuum packaging appliance as recited in claim 1 further comprising:

vacuum chamber portions coupled with said vacuum circuit and for hermetically engaging an opening of a bag-like vacuum packaging receptacle such that actuation of said vacuum pump evacuates said vacuum packaging receptacle.

3. A vacuum packaging appliance as recited in claim 1 further comprising:

a hose coupled to said vacuum circuit, said hose suitable for engaging a container that is formed of a material stiff enough to substantially hold a shape when vacuum evacuated.

4. A vacuum packaging appliance as recited in claim 1, wherein said user input device includes a toggle switch configurable to at least a first position corresponding to said first operating mode and a second position corresponding to said second operating mode.

5. A vacuum packaging appliance as recited in claim 1, wherein said vacuum pump controller includes a microprocessor.

6. A vacuum packaging appliance as recited in claim 1, wherein said vacuum pump controller includes an application specific integrated circuit (ASIC).

7. A vacuum packaging appliance as recited in claim 1, wherein said vacuum pump controller includes a programmable logic device (PLD).

* * * * *